US006327988B1

(12) United States Patent
Seidel

(10) Patent No.: US 6,327,988 B1
(45) Date of Patent: Dec. 11, 2001

(54) SHIP WITH A PROTECTION SYSTEM MAKING IT UNSINKABLE

(76) Inventor: Rainer Seidel, Marienstrasse 12/17, D-59067 Hamm (DE)

( * ) Notice: Subject to any disclaimer, the term of this patent is extended or adjusted under 35 U.S.C. 154(b) by 0 days.

(21) Appl. No.: 09/646,743

(22) PCT Filed: Feb. 11, 1999

(86) PCT No.: PCT/DE99/00381

§ 371 Date: Feb. 12, 2001

§ 102(e) Date: Feb. 12, 2001

(87) PCT Pub. No.: WO99/48751

PCT Pub. Date: Sep. 30, 1999

(30) Foreign Application Priority Data

Mar. 21, 1998 (DE) ..... 198 12 430
May 9, 1998 (DE) ..... 198 20 895

(51) Int. Cl.[7] ..... B63B 43/10
(52) U.S. Cl. ..... 114/68; 114/360
(58) Field of Search ..... 114/68, 69, 360

(56) References Cited

U.S. PATENT DOCUMENTS 1,293,918 * 2/1919 Priolo ..... 114/68
1,335,278 * 3/1920 Donnelly ..... 114/68
3,019,754 * 2/1962 Welshausen ..... 114/68
3,028,828 * 4/1962 Girolame et al. ..... 11/68

FOREIGN PATENT DOCUMENTS 33 35 501 A 4/1985 (DE) .
2 476 588 A 8/1981 (FR) .
2 511 645 A 2/1983 (FR) .
2 120 177 A 11/1983 (GB) .

OTHER PUBLICATIONS

French Publication No. FR 2 476 588 A, published Aug. 28, 1981.
French Publication No. FR 2 511 645 A, published Feb. 25, 1983.
German Publication No. DE 33 35 501 A, published Apr. 18, 1985.
United Kingdom Publication No. GB 2 120 177 A, published Nov. 30, 1983.

* cited by examiner

*Primary Examiner*—Jesus D. Sotélo
(74) *Attorney, Agent, or Firm*—Lahive & Cockfield, LLP

(57) ABSTRACT

A watercraft, e.g. a passenger vessel, a ferry, a hazardous-substance freighter or the like, with a deck and with a buoyancy chamber in the deck, it being the case that, in a first operating state, the buoyancy chamber contains air, is characterized in that, in a second operating state, the buoyancy chamber is filled with a foam which has a high cell volume with closed cells and a dimensionally stable state of aggregation.

10 Claims, 5 Drawing Sheets

SHIP WITH A PROTECTION SYSTEM MAKING IT UNSINKABLE

The present invention relates to a watercraft, e.g. a passenger vessel, a ferry, a hazardous-substance freighter or the like, with a deck and with a buoyancy chamber in the deck, it being the case that, in a first operating state, the buoyancy chamber contains air.

Such watercraft are known from the general prior art, and are vessels, preferably relatively large vessels, with at least one deck and at least one buoyancy chamber in the deck. During normal operation, a first operating state, of such vessels, the buoyancy chambers have been calculated, and filled with ambient air, in accordance with a necessary buoyancy volume. Rather than being restricted to their buoyancy function, the buoyancy chambers usually have very diverse functions. Every separated-off cavity on the ship can be used as a buoyancy chamber, be this a cabin, a bunker, a stowage room or some other kind of chamber. Buoyancy chambers which also have other functions thus also contain, in addition to the ambient air, features which serve for performing these other functions.

In an emergency situation, a second operating state, as arises, for example, in the event of underwater contact, there is threat of water penetrating by leakage. If this is the case, the penetrating water in the corresponding buoyancy chambers displaces the ambient air. This produces losses of buoyancy, which may result in the vessel completely sinking.

SUMMARY OF THE INVENTION

The object of the present invention is thus to provide a watercraft of the generic type mentioned in the introduction in which, when losses of buoyancy occur, the buoyancy can be stabilized immediately.

The object is achieved in that, in a second operating state, the buoyancy chamber is filled with a foam which has a high cell volume with closed cells and a dimensionally stable state of aggregation.

The term "buoyancy chamber" is used hereinbelow, and in the claims, to mean the chambers of a watercraft which, in a second operating state, serve as a stable buoyancy chamber.

The term "cell volume" is used hereinbelow, and in the claims, to mean a large air-absorbing capacity either by virtue of a very large number of small cells or by virtue of a very small number of large cells.

The filling of one or more buoyancy chambers with a dimensionally stable foam with high cell volume if, in an emergency situation, water threatens to penetrate into buoyancy chambers means that the corresponding buoyancy chambers cannot be flooded by water and, on account of the buoyancy volume maintained by the foam, maintain the buoyancy function of the respective buoyancy chamber.

If the buoyancy chambers are multipurpose chambers, e.g. a cabin, it is additionally ensured that the objects in the chamber are enclosed by the foam and are thus protected against damage or loss.

It is advantageous for the buoyancy chamber to comprise a discharge arrangement which, during transition from the first operating state to the second operating state, discharges the foam in an unstable state of aggregation. This simplifies the filling of the respective buoyancy chamber to a considerable extent. It is possible to spray or inject into the buoyancy chamber, for example, foams in a liquid state of aggregation which solidify in the ambient air and reach the stable state of aggregation in a short period of time.

A further advantage is that there is provided a control arrangement which controls the discharge arrangement. Control of the discharge arrangement of each buoyancy chamber makes it possible to select quite specifically discharge arrangements for discharging foam in general and for discharging a metered quantity of foam in particular. This makes it possible to stabilize the buoyancy at different locations of a vessel.

It is advantageous for it to be possible for the control arrangement to be triggered manually in dependence on the detection of a loss of buoyancy. As a result, it is also possible for passenger cabins to be set in a second operating state as buoyancy chambers. Manual triggering makes it possible for the passenger cabin to be inspected carefully, and for it to be ensured that there is no-one still left in the cabin, prior to the triggering operation.

A further advantage is that the control arrangement selects the deck with the buoyancy chamber in dependence on the locality of the loss of buoyancy. This makes it possible for the buoyancy to be stabilized specifically in a deck-specific and loss-dependent manner.

A further advantage is that the control arrangement selects the buoyancy chamber on the deck in dependence on the locality of the loss of buoyancy. This also makes it possible for the buoyancy to be stabilized, in addition, specifically in a chamber-specific and loss-dependent manner.

It is advantageous for there to be provided a number of decks with a number of chambers on which respectively selected chambers are predetermined as the buoyancy chamber in each case. This makes it possible to control the buoyancy very precisely over the entire watercraft.

It is advantageous for each buoyancy chamber to be selected from a group comprising outlying cabins, lounges, bunkers, forechambers, aftchambers, stowage rooms and forepeak and steering gear. Utilization of all the functional chambers as buoyancy chambers makes it possible to ensure optimum buoyancy in the event of an emergency.

A further advantage, is that, in its dimensionally stable state of aggregation, the foam is pressure-resistant. This ensures that the buoyancy chamber remains as such even in the case of elevated external pressure.

It is advantageous for the foam to be a plastic foam which contains a foam stabilizer. The prior art discloses numerous plastic foams which, on account of the foam stabilizers, have the required features, high cell volume, pressure resistance and dimensional stability, with the result that it is easy to make a suitable selection.

BRIEF DESCRIPTION OF THE DRAWINGS

An embodiment of the present invention is described in more detail hereinbelow with reference to the drawings, in which.

DESCRIPTION OF ILLUSTRATED EMBODIMENTS

Figure 1:
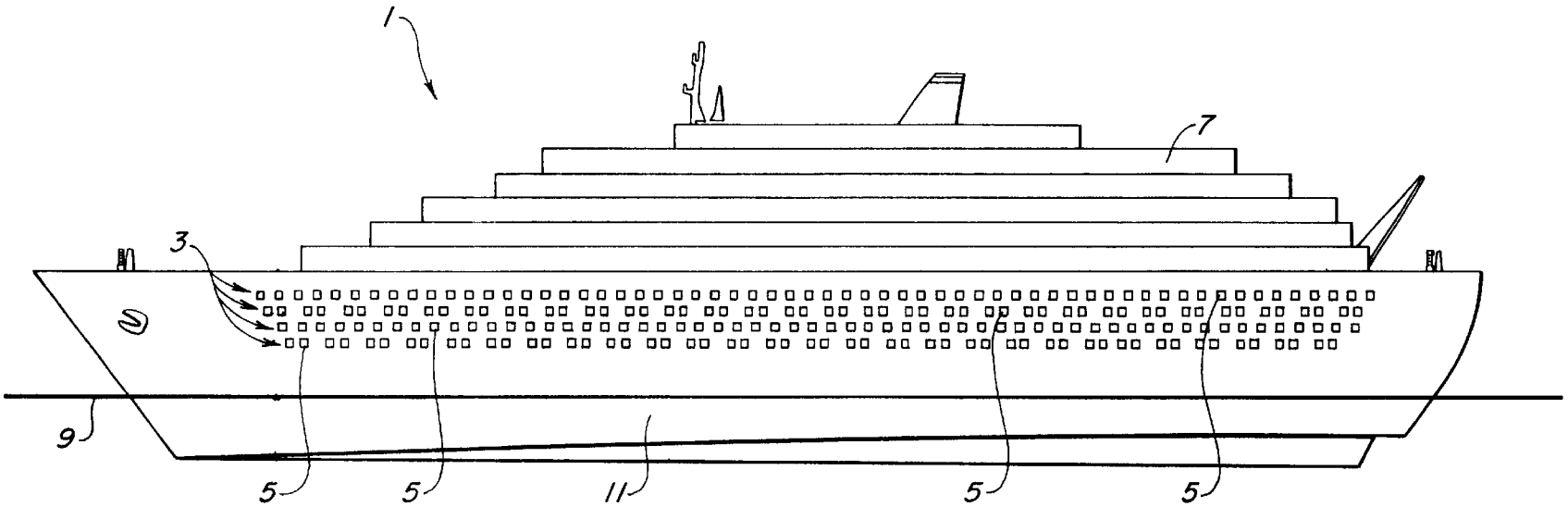
FIG. 1 shows a schematic view of a passenger vessel which is designed according to the invention.

FIG. 1 gives a schematic illustration of a passenger vessel as the watercraft 1. In the present exemplary embodiment, the passenger vessel is to have a weight of approximately 4000 n.r.t. (net registered tons) and 6000 g.r.t. (gross registered tons). In a rescue situation in the event of an accident or the like, the maximum mass which is to be brought under control is approximately 4100 g.r.t. The buoyancy volume comprising just two decks (passenger decks) 3 with a total of approximately 200 buoyancy chambers (cabins) 5 each having a buoyancy force of 20 t is at least 4000 t. The buoyancy volumes of buoyancy chambers fore and aft add up to at least 1000 t. This gives an overall buoyancy volume of approximately 5000 t, that is to say a reserve buoyancy of at least 900 t.

A number of upper decks 7 are provided above the decks 3.

In FIG. 1, the watercraft 1 is operating normally; there is no emergency.

The waterline is designated 9 and located in a bottom region of the hull 11.

Figure 2:
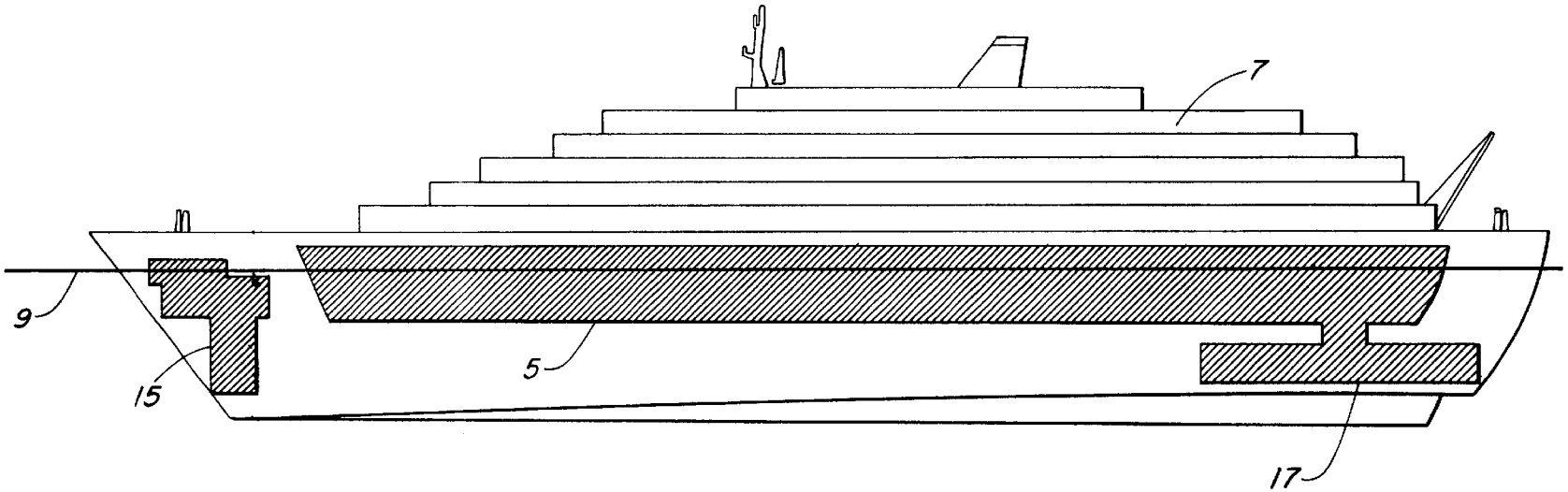
FIG. 2 shows a schematic view of the passenger vessel from FIG. 1 with buoyancy chambers foam-filled according to the invention.

In FIG. 2, the watercraft 1 is in a rescue situation, i.e. an emergency situation. The waterline 9 is located in a top region of the hull 11.

It is illustrated schematically that the buoyancy chambers 5 of the passenger decks, in particular the outer buoyancy chambers, have been filled with a foam (illustrated in black) 13. However, buoyancy chambers in the fore quarters 15 of the vessel and in the aft quarters 17 of the vessel have also been filled with foam.

Figure 3:
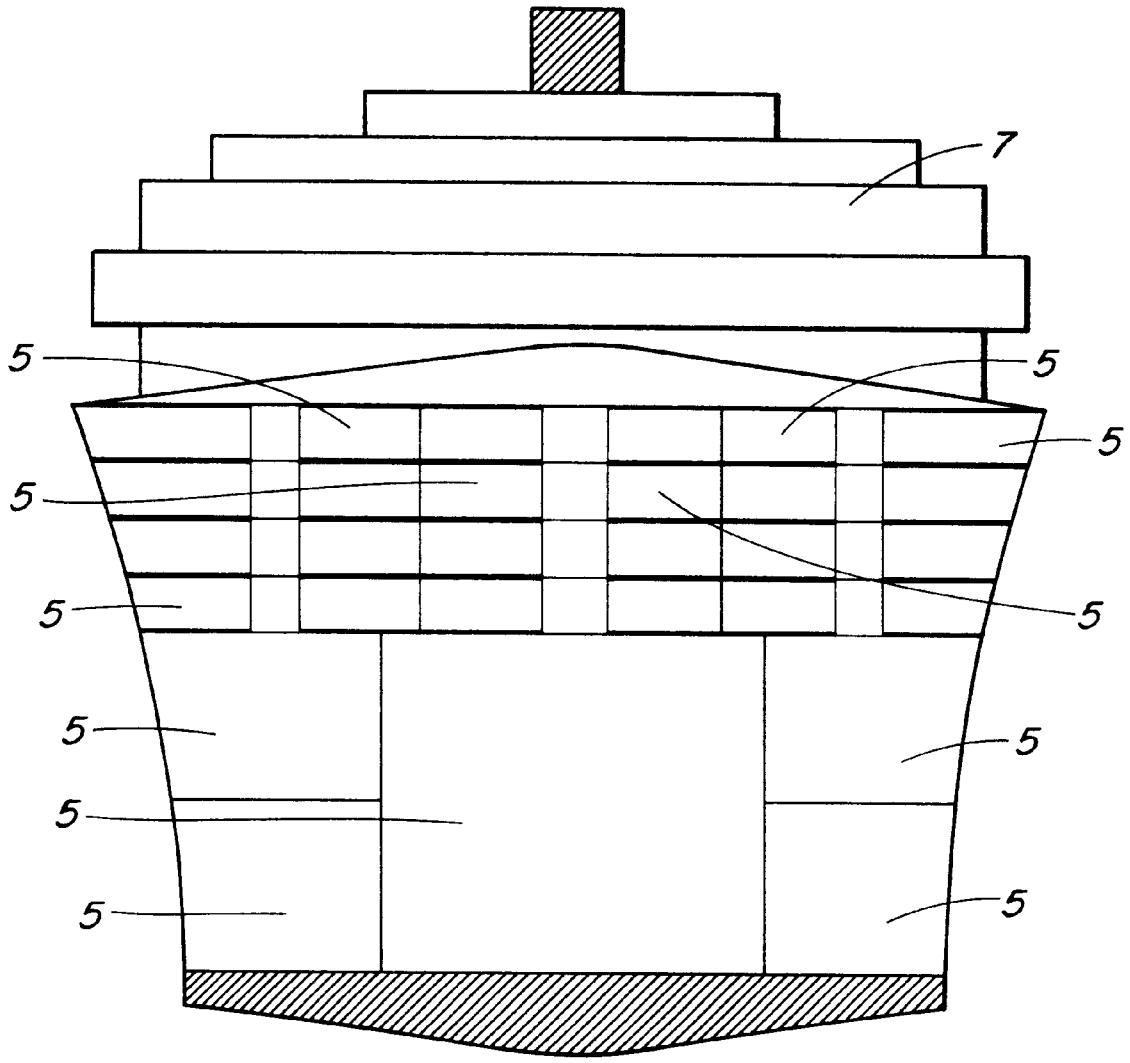
FIG. 3 shows a schematic front view of the passenger vessel with chambers.
Figure 4:
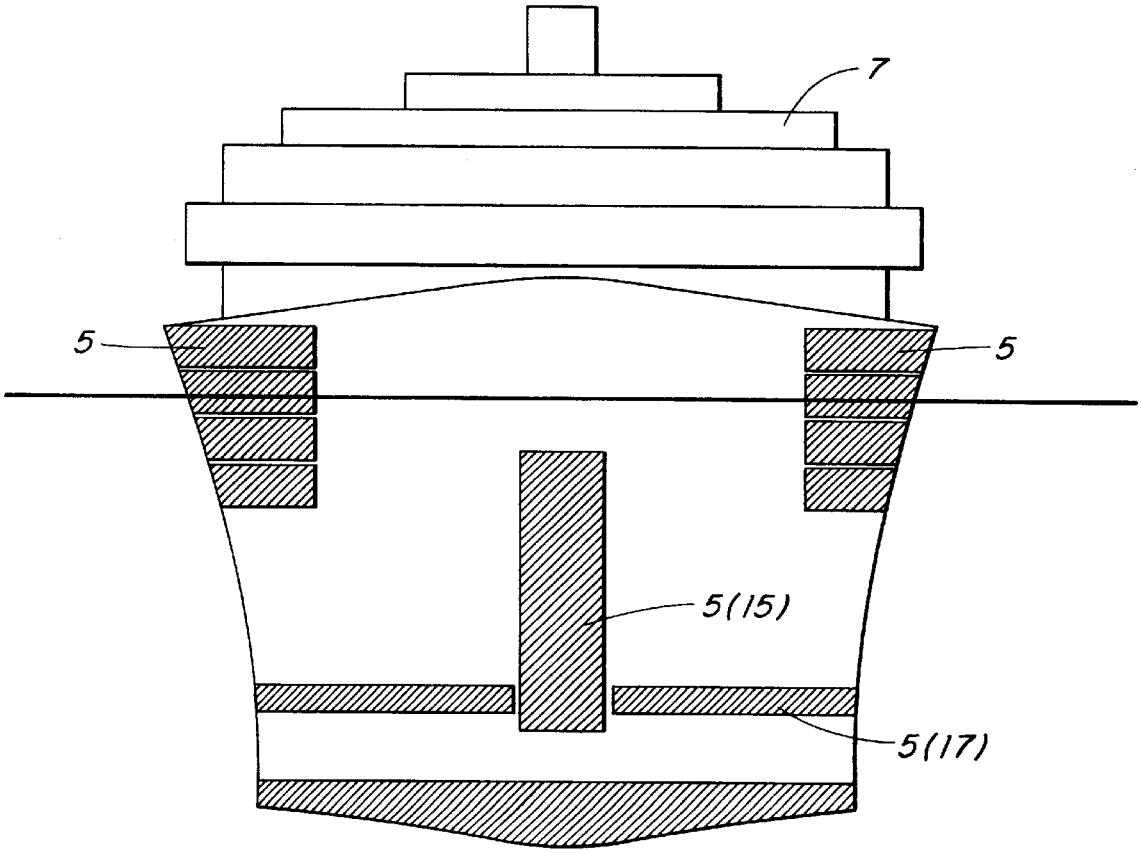
FIG. 4 shows a schematic front view of the passenger vessel from FIG. 2 with buoyancy chambers foam-filled according to the invention.

FIG. 3 shows the watercraft 1 from the front. The buoyancy chambers 5 inside the vessel are illustrated schematically. Theoretically, it is possible for all buoyancy chambers 5 illustrated to be filled with a foam in the event of an emergency. In practice, however, a few buoyancy chambers 5 are selected for this purpose. These buoyancy chambers 5 are illustrated in FIG. 4. For the passenger vessel used as an exemplary embodiment, the outer cabins of all the (passenger) decks 3, the fore quarters 15 of the ship and, likewise illustrated here, the steering gear in the aft quarters 17 of the vessel each serve as buoyancy chamber 5.

The upper decks 7 serve as escape decks.

Figure 5:
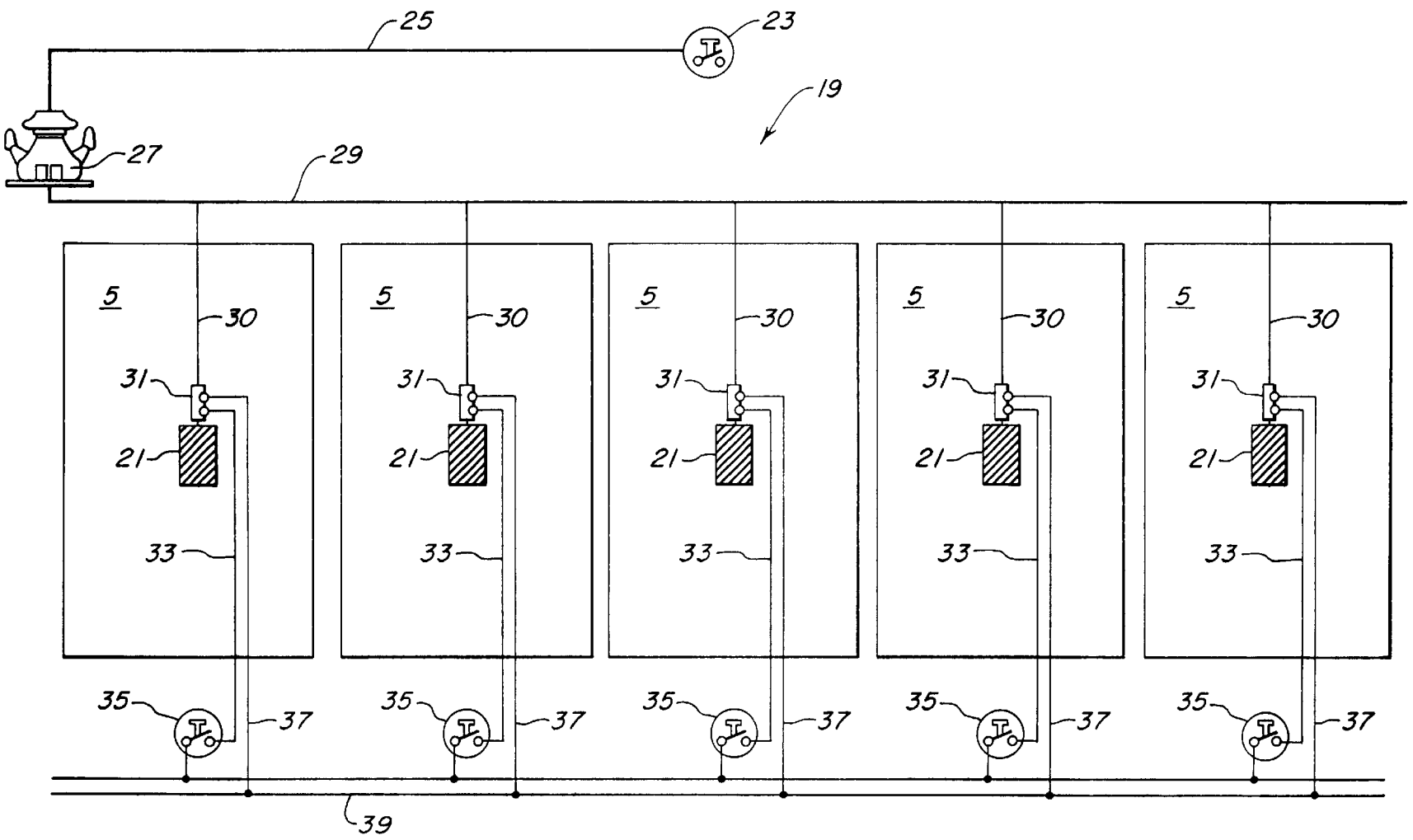
FIG. 5 shows a schematic illustration of a control arrangement for filling the buoyancy chambers of the passenger vessel with foam.

A control arrangement 19 is illustrated schematically in FIG. 5. The control arrangement 19 controls a discharge arrangement 21, which is arranged in each of the buoyancy chambers 5 selected for the emergency. The discharge arrangement 21 is preferably a tank which is installed on the ceiling of the respective buoyancy chamber 5 and in which the foam is stored in a dimensionally unstable, that is to say liquid or gaseous, state of aggregation. The ceiling installation ensures favourable, uniform filling of the buoyancy chamber.

Arranged in a command center, e.g. on the bridge of the passenger vessel, is an emergency switch 23 which is operatively connected to a gas-pressure generator 27 via a line 25. The gas-pressure generator 27 is operatively connected, via a system of lines 29, 30 with a valve arrangement 31, e.g. a solenoid valve, to each discharge arrangement 21 in each buoyancy chamber 5.

In addition, the valve arrangement 31 is operatively connected to a safety switch 35 via a further line 33.

In the event of an emergency situation, the emergency switch 23 is actuated. As a result, the gas-pressure generator 27 generates a gas pressure in the system of lines 29, 30. If the selected buoyancy chambers 5 are passenger cabins or chambers in which there may be people, the buoyancy chambers 5 are inspected by the staff. If the staff establish that a buoyancy chamber 5 is empty, the safety switch 35 is actuated, as a result of which the valve arrangement 31 opens and the gas pressure in the line 30 is transmitted to the discharge arrangement 21. As a result, the foam, which is present in the dimensionally unstable state of aggregation, is driven out of the discharge arrangement 21 and sprayed or injected into the buoyancy chamber 5. The foam solidifies in ambient air with the already mentioned properties and ensures the buoyancy function of the corresponding buoyancy chamber 5.

The control arrangement 19 may be designed such that certain decks 3 and buoyancy chambers 5 can be targeted quite specifically, via the system of lines 29, 30, in dependence on the locality of a loss of buoyancy.

The foam may be a mineral or organic natural foam or plastic foam with or without a foam stabilizer. Foams with the abovementioned properties are known in general from the prior art, so these will not be described in any more detail here.

Upon actuation, the safety switch 35 closes a circuit for triggering the valve arrangement and, at the same time, opens a network circuit for the corresponding buoyancy chamber.

What is claimed is:

1. A watercraft, comprising a deck and a buoyancy chamber in the deck, wherein in a first operating state, the buoyancy chamber contains air, and in a second operating state, the buoyancy chamber is filled with a foam which has a high cell volume with closed cells and a dimensionally stable state of aggregation.

2. A watercraft according to claim 1, wherein the buoyancy chamber comprises a discharge arrangement which, during transition from the first operating state to the second operating state, discharges the foam in a dimensionally unstable state of aggregation.

3. A watercraft according to claim 2, further comprising a control arrangement for controlling the discharge arrangement.

4. A watercraft according to claim 3, wherein the control arrangement is triggered manually in dependence on the detection of a loss of buoyancy.

5. A watercraft according to claim 4, wherein the control arrangement selects the deck with the buoyancy chamber in dependence on the locality of the loss of buoyancy.

6. A watercraft according to claim 4, wherein the control arrangement selects the buoyancy chamber on the deck in dependence on the locality of the loss of buoyancy.

7. A watercraft according to claim 1, further comprising a plurality of decks with a number of chambers in which respectively selected chambers are predetermined as the buoyancy chamber in each case.

8. A watercraft according to one of the preceding claims, characterized in that each buoyancy chamber (5) is selected from a group comprising cabins, lounges, bunkers, forechambers, aftchambers, stowage rooms, forepeak and steering gear.

9. A watercraft according to claim 1, wherein in its dimensionally stable state of aggregation, the foam is pressure-resistant.

10. A watercraft according to claim 1, wherein the foam is a plastic foam which contains a foam stabilizer.

* * * * *